US008191205B2

(12) United States Patent
Forrest

(10) Patent No.: US 8,191,205 B2
(45) Date of Patent: Jun. 5, 2012

(54) DOOR HINGE

(75) Inventor: Earl David Forrest, Asheboro, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 997 days.

(21) Appl. No.: 11/958,496

(22) Filed: Dec. 18, 2007

(65) Prior Publication Data

US 2009/0151124 A1 Jun. 18, 2009

(51) Int. Cl.
*E05D 11/00* (2006.01)

(52) U.S. Cl. ..... 16/273; 16/386; 16/DIG. 27

(58) Field of Classification Search ..... 16/334, 16/374, 375, 377, DIG. 27, 273, 342, 2.1, 16/380–381, 385–387, 337; 384/281
See application file for complete search history.

(56) References Cited

U.S. PATENT DOCUMENTS

| | | | | |
|---|---|---|---|---|
| 111,515 | A | 2/1871 | Clark | |
| 112,978 | A | 3/1871 | St. John | |
| 698,884 | A | 4/1902 | Wheeler | |
| 1,738,015 | A | 12/1929 | Parsons | |
| 1,936,769 | A | 11/1933 | Olivet | |
| 2,000,856 | A | 5/1935 | Lyons | |
| 2,010,659 | A | 8/1935 | Ferris | |
| 2,154,860 | A | 4/1939 | Morse | |
| 2,214,348 | A | 9/1940 | Roth | |
| 2,772,441 | A | 12/1956 | Riser | |
| 3,013,297 | A | 12/1961 | Ferry | |
| 3,015,126 | A * | 1/1962 | Ahlgren | 16/386 |
| 3,068,508 | A | 12/1962 | Heyer | |
| 3,216,053 | A | 11/1965 | Felix | |
| 3,216,054 | A * | 11/1965 | Cain | 16/390 |
| 3,499,183 | A | 3/1970 | Parsons | |
| 3,921,225 | A | 11/1975 | Suska | |
| 4,353,146 | A | 10/1982 | Brockhaus | |
| 4,475,266 | A | 10/1984 | Suska | |
| 4,675,940 | A | 6/1987 | Brockhaus | |
| 4,896,188 | A | 1/1990 | Byers | |
| 4,964,193 | A | 10/1990 | Rommelfaenger et al. | |
| 5,012,555 | A | 5/1991 | Byers | |
| 5,014,087 | A | 5/1991 | Byers | |
| 5,463,795 | A | 11/1995 | Carlson et al. | |
| 5,491,874 | A | 2/1996 | Lowry et al. | |
| 5,752,293 | A | 5/1998 | Lowry et al. | |
| 5,930,868 | A | 8/1999 | Butler | |
| 6,173,475 | B1 | 1/2001 | Senn et al. | |
| 6,808,333 | B2 | 10/2004 | Friesen et al. | |
| 6,859,980 | B2 | 3/2005 | Baer | |
| 2004/0025296 | A1 | 2/2004 | Wade | |
| 2008/0104798 | A1 * | 5/2008 | Hoppe et al. | 16/236 |
| 2010/0146734 | A1 * | 6/2010 | Munson et al. | 16/334 |

* cited by examiner

*Primary Examiner* — William L. Miller
(74) *Attorney, Agent, or Firm* — Carlson, Gaskey & Olds, P.C.

(57) ABSTRACT

An example hinge includes a hinge pin extending along an axis and a first knuckle for receiving the hinge pin. The first knuckle is rotatable about the axis. A second knuckle for receiving the hinge pin and is rotatable about the axis. At least one bearing limits relative rotation between the first hinge knuckle and the hinge pin. The example hinge assembly may include a tolerance ring between the hinge pin and the first knuckle to urge the bearing away from the axis. An example method of producing a hinge includes the steps of permitting a first hinge plate to move relative a hinge pin and limiting movement of a second hinge plate relative a hinge pin. The method biases a bearing adjacent the hinge pin to limit movement of the second hinge plate relative the hinge pin.

18 Claims, 5 Drawing Sheets

DOOR HINGE

BACKGROUND OF THE INVENTION

This invention relates generally to a hinge and a method of fabricating a hinge with reduced clearance between hinge components.

Residential hinges secure a door to a door frame. Some known hinges maintain or hold the door position as the door opens and closes. Smooth door movements are desirable, especially in residential environments.

Typical hinges include a hinge pin extending through knuckles to pivotably join two hinge halves. The knuckles rotate relative to each other and contact the hinge pin as the door moves, which may result in a concentrated load on the hinge pin. Concentrated loads on the hinge pin can unevenly wear the hinge components. In some hinges, metal hinge pins can rub against metal hinge knuckles as the hinge moves.

Excessive clearance between the hinge components can result in undesirable looseness, sometimes referred to as chuck, as the door moves between open and closed positions. Wearing the hinge surfaces increases clearance between hinge components, which increases looseness and chuck within the hinge assembly. Particulate matter such as dust and dirt often undesirably accumulates within areas of clearance between the hinge components.

SUMMARY OF THE INVENTION

An example hinge includes a hinge pin extending along an axis and a first knuckle for receiving the hinge pin. The first knuckle is rotatable about the axis. A second knuckle also receives the hinge pin and is rotatable about the axis. A bearing limits relative rotation between the first knuckle and the hinge pin. The example hinge assembly may include a tolerance ring between the hinge pin and the first knuckle to urge the bearing away from the axis.

An example bearing arrangement for hinge components includes a bearing mountable about a hinge pin that extends along a rotational axis. A tolerance ring is mountable about the bearing that biases the bearing to limit relative rotational movement between the hinge pin and a hinge knuckle about the rotational axis. The bearing arrangement may include a flange extending from the bearing to prevent a hinge knuckle on a first hinge half from contacting a hinge knuckle on the second hinge half.

An example method of moving a hinge includes the steps of permitting a first hinge plate to move relative a hinge pin and limiting movement of a second hinge plate relative a hinge pin. The method biases a bearing adjacent the hinge pin to limit movement of the second hinge plate relative the hinge pin.

These and other features of the application can be best understood from the following specification and drawings, the following of which is a brief description.

DETAILED DESCRIPTION OF AN EXAMPLE EMBODIMENT

Figure 1:
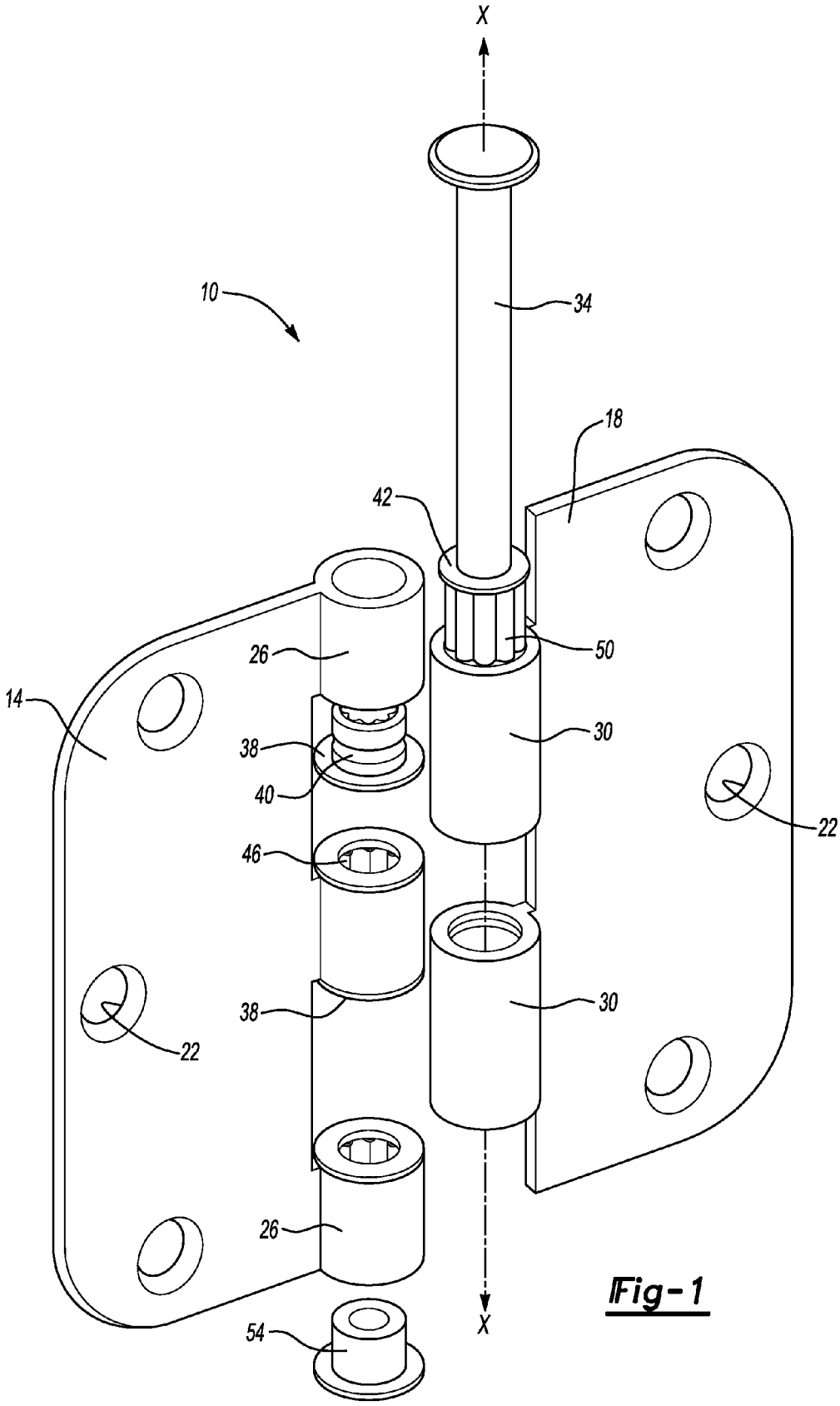
FIG. 1 is an exploded view of an example hinge assembly.
Figure 2:
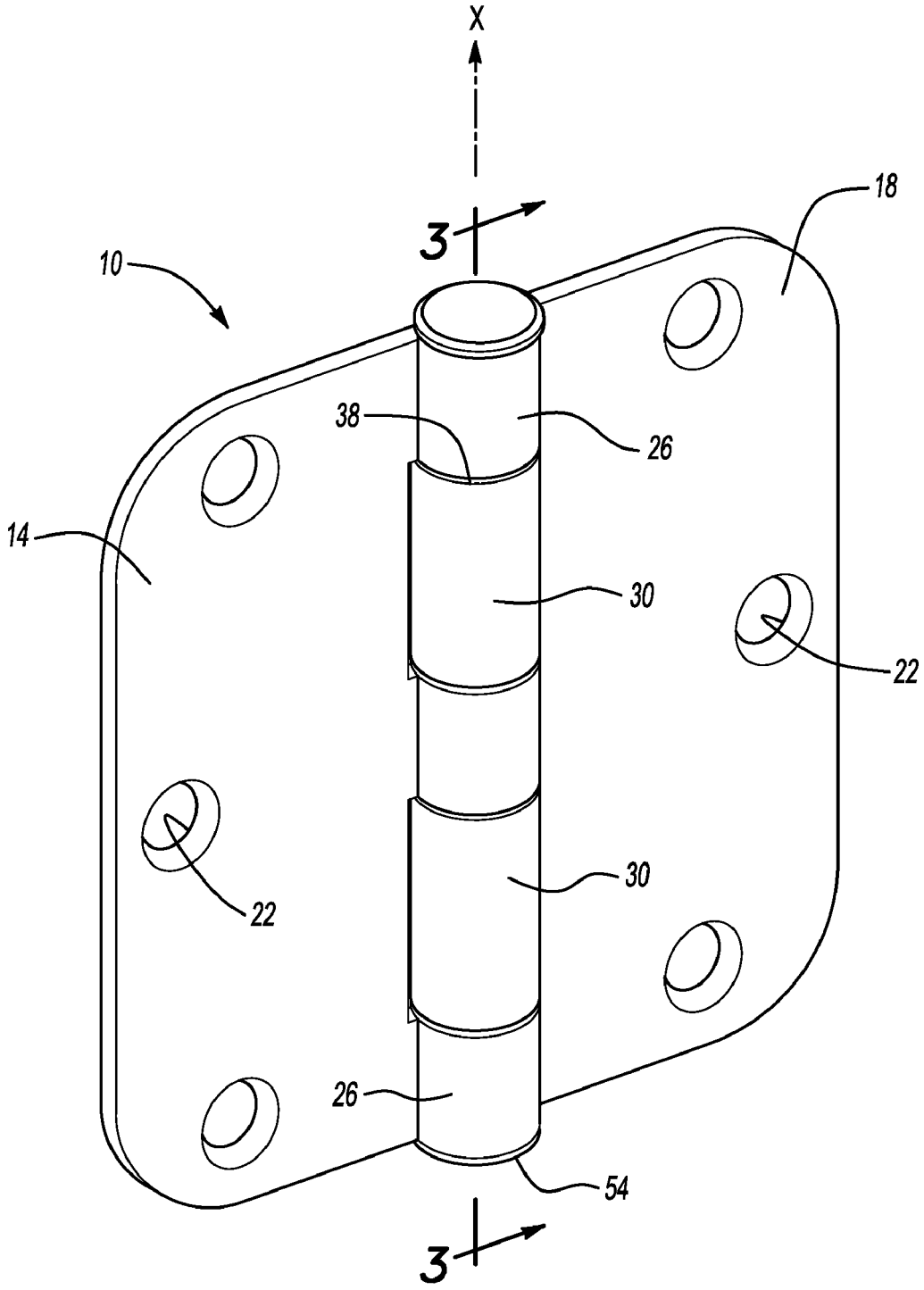
FIG. 2 is a perspective view of the example hinge assembly of FIG. 1 in an assembled position.

Referring to FIGS. 1 and 2, an example hinge assembly 10 includes a first hinge plate 14 and a second hinge plate 18. The first hinge plate 14 and the second hinge plate 18 include a plurality of apertures 22 for securing the hinge assembly 10 to a door and a door frame in a known manner.

A first knuckle 26 extends from the first hinge plate 14. A second knuckle 30 extends from the second hinge plate 18. The first knuckle 26 and the second knuckle 30 receive a hinge pin 34, which joins the first hinge plate 14 to the second hinge plate 18. The hinge pin 34 extends along an axis X. When assembled, the first hinge plate 14 moves relative the second hinge plate 18 by rotating about the axis X.

The first knuckle 26 also receives a thrust bearing 38 for limiting radial and axial movement of the hinge pin 34. The second knuckle 30 receives a radial bearing 42. The thrust bearing 38 includes a tolerance ring 46, a type of biasing member, adjacent an inner surface. The radial bearing 42 includes another tolerance ring 50 adjacent an outer surface. A decorative end cap 54 covers an open end of one of the first knuckles 26.

Figure 3:
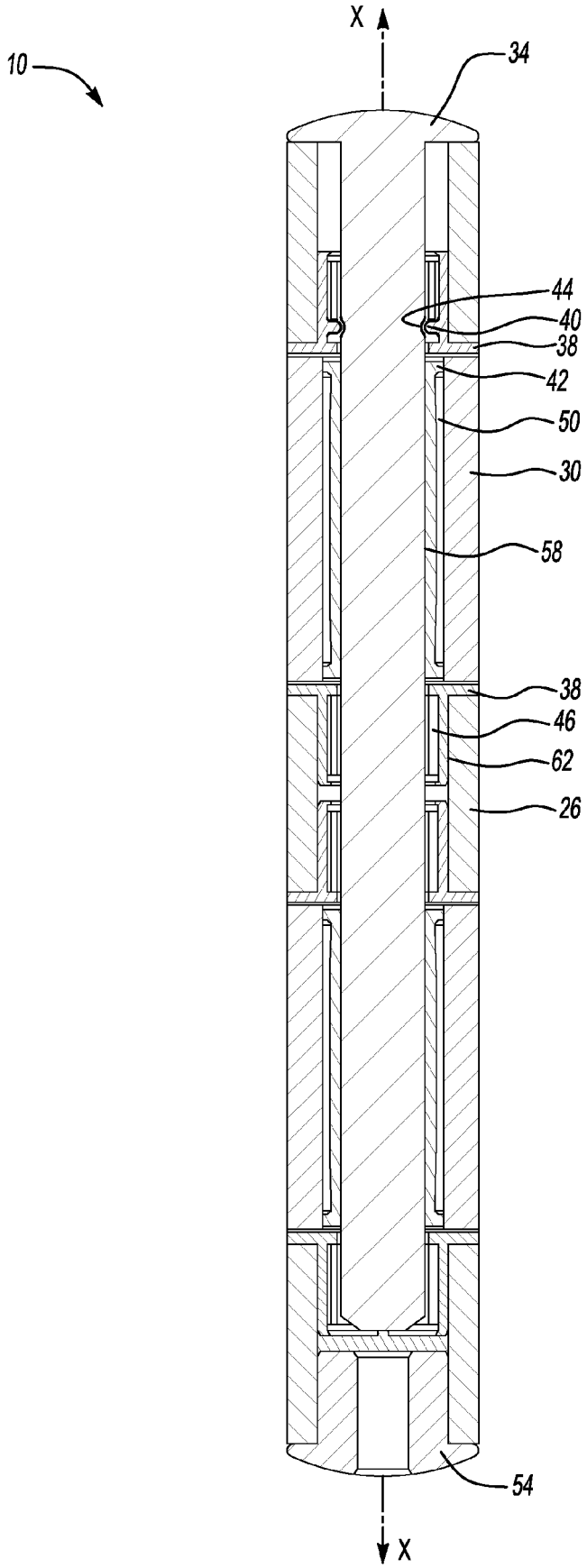
FIG. 3 is a cross-sectional view through the assembled hinge of FIG. 2.

Referring now to FIG. 3 with continuing reference to FIGS. 1 and 2, the thrust bearing 38 closest the upper portion of the hinge assembly 10 includes a rib 40, which extends inward toward the axis X. The rib 40 provides an anti-rise feature for the hinge pin 34 by limiting movement of the hinge pin 34 away from an installed position. The rib 40 contacts a groove 44 in the hinge pin 34 to limit axial movement of the hinge pin 34.

The radial bearing 42 includes an inner surface 58 directly contacting the hinge pin 34. The tolerance ring 50 biases the inner surface 58 of the radial bearing 42 toward the axis X of the hinge pin 34. As the first hinge plate 14 rotates relative the second hinge plate 18 about axis X, the inner surface 58 rotates relative the hinge pin 34. The hinge pin 34 is comprised of a metal material. The inner surface 58 is of a softer material than the example hinge pin 34. The inner surface 58 can be comprised of material such as Delrin, for example. As the radial bearing 42 is softer, relative movement between the inner surface 58 and the hinge pin 34 wears the inner surface 58, but not the hinge pin 34.

Within the first knuckle 26, another tolerance ring 46 directly contacts the hinge pin 34 and biases an outer surface 62 of the thrust bearing 38 toward an inner surface of the first knuckle 26. As the first hinge plate 14 rotates relative the second hinge plate 18, the outer surface 62 of the thrust bearing 38 contacts the first knuckle 26 to limit relative rotation. The portion of the thrust bearing 38 having the outer surface 62 is a softer material than the first knuckle 26. Thus, the outer surface 62 of the thrust bearing 38 wears more than the first knuckle 26.

The tolerance rings 46, 50 accommodate some clearances within the hinge assembly 10. As the radial bearing 42 wears, the tolerance rings 50 bias further toward the worn surfaces. The inner surface 58 is forced closer to all sides of the hinge pin 34. The tolerance rings 50 thereby lessen perceived chuck or looseness within the hinge assembly 10 as the first hinge plate 14 rotates relative the second hinge plate 18. The biasing of the tolerance rings 46, 50 also facilitates reduction in point loads or load concentrations on the hinge pin 34 through the first knuckle 26 or the second knuckle 30. Instead, loads are distributed radially about the first knuckle 26, the second knuckle 30, and the hinge pin 34.

Figure 4:
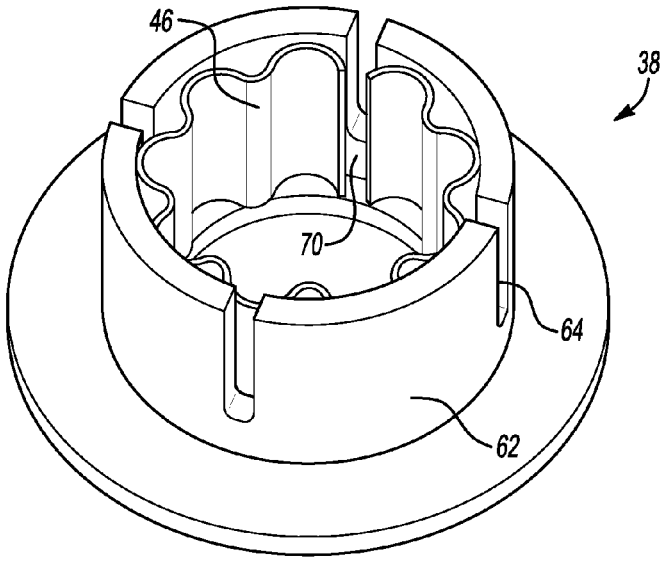
FIG. 4 is a perspective view of an example thrust bearing.
Figure 5:
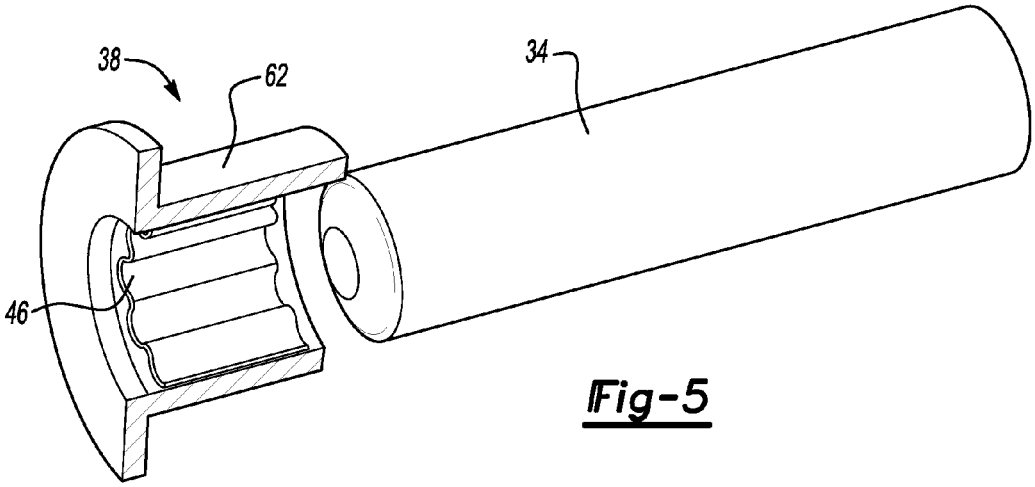
FIG. 5 is an exploded view the FIG. 4 thrust bearing prior to moving to an installed condition around a hinge pin.
Figure 6:
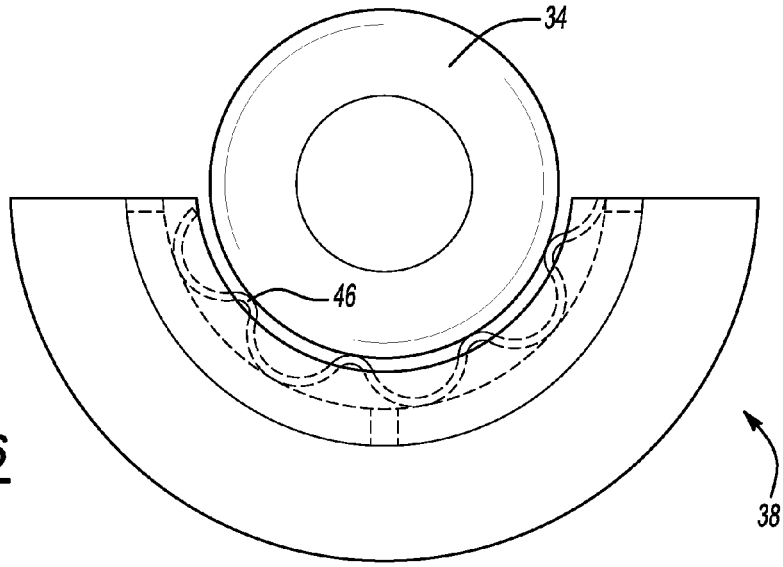
FIG. 6 is an end view of the FIG. 5 thrust bearing.

As shown in FIGS. 4-6, the outer surface 62 of the radial bearing 38 is generally smooth, which facilitates load distribution across the outer surface 62 relative the inner surface of the first knuckle 26 (FIG. 1). Conversely, the hinge pin 34 only contacts the tolerance ring 46 at a few locations resulting in a reduced distributed load than the load exerted by the outer surface 62 on the first knuckle 26. The tolerance ring 46 and the hinge pin 34 are made from similar materials, which, with the less distributed load, makes it more likely for the radial bearing 38 to move relative the first knuckle 26 than the hinge pin 34. Accordingly, moving the first hinge plate 14 relative the second hinge plate 18 does not result in substantial relative rotation between the hinge pin 34 and the first hinge plate 14. The tolerance ring 46 grips on the hinge pin 34 to limit axial movements of the hinge pin 34.

Figure 7:
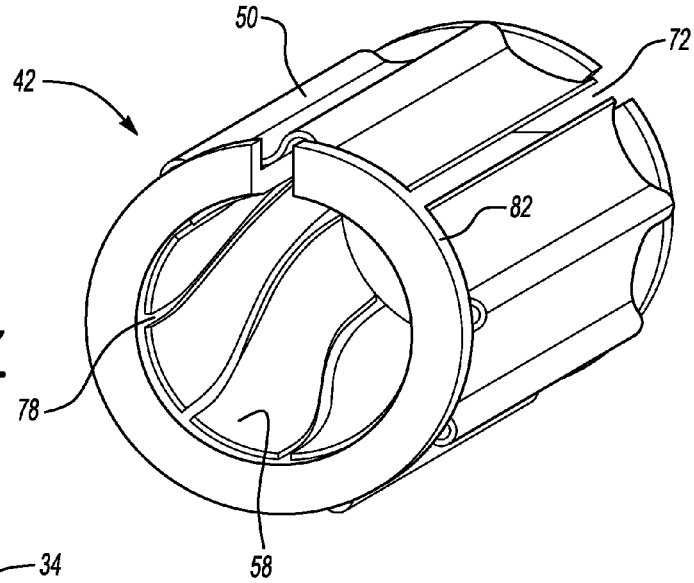
FIG. 7 is a perspective view of an example wave bearing.
Figure 8:
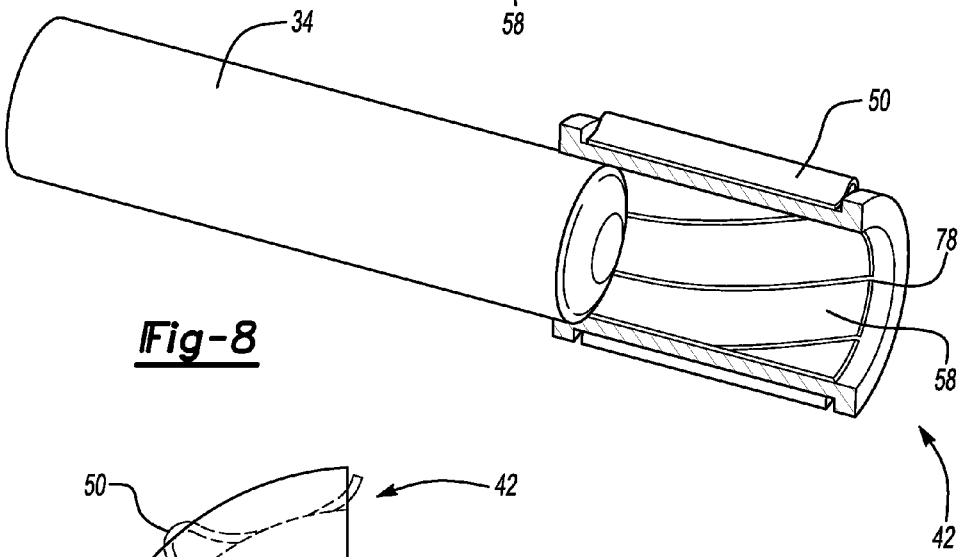
FIG. 8 is an exploded view of the FIG. 7 wave bearing prior to moving to an installed condition around a hinge pin.
Figure 9:
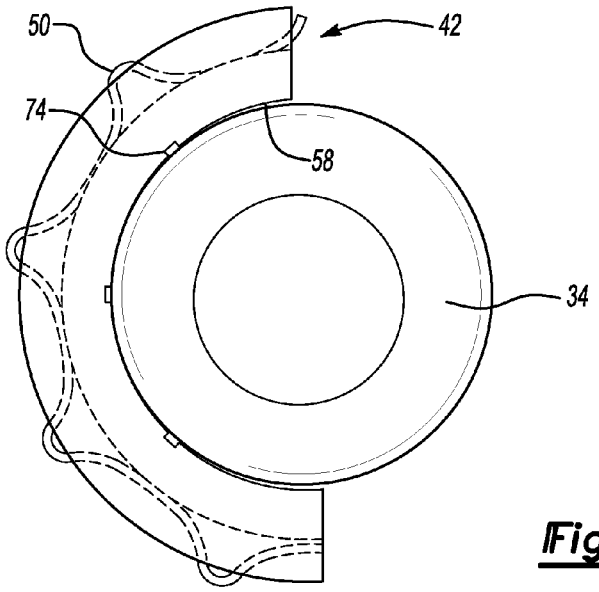
FIG. 9 is an end view of the FIG. 8 radial bearing.

Referring now to FIGS. 7-9 with continuing reference to FIG. 1, the tolerance ring 50 contacts the second knuckle 30 at a few locations due to the tolerance ring 50 profile. Accordingly, the biasing load moving from the tolerance ring 50 to the second knuckle 30 is less distributed than the biasing load moving from the tolerance ring 50 through the radial bearing 42 to the hinge pin 34. Further, the tolerance ring 50 and the second knuckle 30 are made from similar metallic materials, which tends to makes it more likely for the radial bearing 42 to move relative the hinge pin 34 than relative the second knuckle 30, especially with the less distributed load. Accordingly, moving the second hinge plate 18 relative the first hinge plate 14 results in relative rotation between the hinge pin 34 and the second hinge plate 18 rather than between the first hinge plate 14 and the hinge pin 34.

In this example, the thrust bearing 38 includes a flange portion extending outside of the first knuckle 26. The portion prevents contact between the first knuckle 26 and the second knuckle 30.

Modifying the size and location of a gap 72 within the tolerance ring 50 provides for adjusting or tuning installation efforts of the radial bearing 42 within the second knuckle 30. The radial bearing 42 in this example also includes a flange 82. Adjusting the outer diameter of the flange 82 may similarly help control installation efforts of the radial bearing 42. Further, adjusting the size of the notch 64 (FIG. 4) controls the amount of flex within the thrust bearing 38 and may similarly be used to tune installation efforts of the thrust bearing 38.

Although the tolerance rings 46, 50 are described as including a wave form outer surface, those skilled in the art and having the benefit of this disclosure would understand similar biasing members could be used to direct or bias the radial bearing 42 and the thrust bearing 38 in an appropriate direction toward or away from the axis X. Other tolerance rings 46, 50 may include engineering composite bearings for example.

Movements of the hinge assembly 10 can generate undesirable particulate matter, such as dust and dirt. A notch 64 facilitates adapting the thrust bearing 38 to variations in hinge knuckle 26 size. A plurality of grooves 78 arranged in a helical fashion relative the axis X communicate particulate matter from the hinge assembly 10. Adjusting the depth and overall size of the grooves 78 provides control of installation efforts of the radial bearing 42 around the hinge pin 34. Grooves could also be substantially aligned with axis X.

Referring again to FIG. 1, increasing the size of the hinge assembly 10 may require increasing adjusting a height ratio between the second knuckle 30 and the first knuckle 26. In one example, the height of the second knuckle 30 increases relative the first knuckle 26. Increasing the relative height of the second knuckle 30 accommodates a larger radial wave bearing 42 for transferring the increased loads of a larger hinge assembly 10. Further, increasing the size of the radial wave bearing 42 lessens the chance of cold forming the radial wave bearing 42 under a continuous load. Cold forming can cause inconsistencies in the surface of the radial wave bearing 42, which could cause uneven wear surfaces.

Although a preferred embodiment of this invention has been disclosed, a worker of ordinary skill in this art would recognize that certain modifications would come within the scope of this invention. For that reason, the following claims should be studied to determine their true scope and content of this invention.

I claim:

1. A hinge, comprising:

a hinge pin extending along an axis;

a first hinge plate including a first knuckle receiving said hinge pin and rotatable about said axis;

a second hinge plate including a second knuckle receiving said hinge pin and rotatable about said axis;

at least one first bearing disposed between said first knuckle and said hinge pin for limiting relative rotation between said first knuckle and said hinge pin; and a tolerance ring between said hinge pin and said first knuckle, said tolerance ring urging said at least one first bearing away from said axis, wherein said tolerance ring is a separate piece.

2. The hinge of claim 1, wherein said first knuckle houses at least a portion of said at least one first bearing.

3. The hinge of claim 1, wherein said at least one first bearing includes a surface contacting said first knuckle, said surface facilitating relative movement between said at least one first bearing and said first knuckle.

4. The hinge of claim 1, wherein said at least one first bearing comprises a polymer material.

5. The hinge of claim 1, including at least one second bearing for limiting movement of said hinge pin away from said axis.

6. The hinge of claim 5, wherein said second knuckle houses at least a portion of said at least one second bearing.

7. The hinge of claim 5, including a second tolerance ring positioned between said hinge pin and said second knuckle for urging said at least one second bearing toward said axis.

8. The hinge of claim 5, wherein a wear surface of said at least one second bearing contacts opposing sides of said hinge pin as said second knuckle moves relative said hinge pin.

9. The hinge of claim 8, wherein said wear surface includes at least one groove.

10. The hinge of claim 9, wherein said at least one groove is helical.

11. The hinge of claim 9, wherein said wear surface comprises a Delrin material.

12. The hinge of claim 5, wherein said at least one second bearing moves with said second knuckle as said one second knuckle moves relative said hinge pin about said axis.

13. The hinge of claim 1, wherein said first hinge plate is attachable to at least one of a door frame and a door.

14. A method of arranging a hinge assembly, comprising the steps of:

(a) permitting a first hinge plate to move relative a hinge pin about an axis;

(b) limiting movement of a second hinge plate relative the hinge pin, wherein the hinge pin is received within a first knuckle and a second knuckle, the first knuckle extending from the first hinge plate, and the second knuckle extending from the second hinge plate;

(c) using a first biasing member to bias a first bearing to limit movement of the second hinge plate relative the hinge pin, at least a portion of the first bearing positioned radially between the second knuckle and the hinge pin;

(d) biasing the first bearing away from the axis; and (e) biasing a second bearing toward the axis using a second biasing member, the second bearing positioned radially between the first knuckle and the hinge pin.

15. The method of claim 14, wherein the first biasing member comprises a tolerance ring.

16. A hinge assembly, comprising:

a hinge pin extending along an axis;

a first hinge plate assembly that includes a first knuckle receiving at least a portion of said hinge pin, said first hinge plate assembly rotatable about said axis;

a second hinge plate assembly that includes a second knuckle configured to receive at least a portion of said hinge pin, said second hinge plate assembly rotatable about said axis;

a first bearing disposed between said first knuckle and said hinge pin;

a first biasing member configured to bias said bearing toward said first knuckle or said hinge pin to limit relative rotation between said first knuckle and said hinge pin; and including a second bearing disposed between said second knuckle and said hinge pin, and a second biasing member biasing said second bearing toward said hinge pin to limit movement of said hinge pin away from said axis.

17. The hinge assembly of claim 16, wherein said first biasing member comprises a tolerance ring.

18. The hinge assembly of claim 16, wherein said first knuckle, said first bearing, and said hinge pin rotate together about said axis relative to said second knuckle and said second bearing.

* * * * *